US006581928B1

(12) United States Patent
Stephan

(10) Patent No.: US 6,581,928 B1
(45) Date of Patent: Jun. 24, 2003

(54) SHEET GUIDE DEVICE FOR SHEET-PROCESSING MACHINE

(75) Inventor: Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 9 days.

(21) Appl. No.: 09/693,775

(22) Filed: Oct. 20, 2000

Related U.S. Application Data

(60) Provisional application No. 60/191,154, filed on Mar. 22, 2000.

(30) Foreign Application Priority Data

Oct. 20, 1999 (DE) ..... 199 50 408

(51) Int. Cl.[7] ..... B65H 29/70

(52) U.S. Cl. ..... 271/188; 271/209; 271/171; 271/195

(58) Field of Search ..... 271/188, 171, 271/209, 264, 161, 195–196; 198/817, 836.3

(56) References Cited

U.S. PATENT DOCUMENTS

| | | | | |
|---|---|---|---|---|
| 3,934,872 A | * | 1/1976 | Honkawa | 101/232 |
| 4,572,073 A | | 2/1986 | Mitze et al. | |
| 4,958,722 A | * | 9/1990 | Kobayashi et al. | 198/735.3 |
| 5,091,754 A | * | 2/1992 | Abe et al. | 271/188 |
| 5,634,765 A | * | 6/1997 | Miyoshi | 29/809 |
| 5,871,434 A | * | 2/1999 | Eckelt et al. | 271/188 |
| 5,937,260 A | * | 8/1999 | Taninaka et al. | 399/401 |
| 6,149,150 A | * | 11/2000 | Onipchenko et al. | 271/227 |
| 6,182,567 B1 | * | 2/2001 | Gunschera et al. | 101/232 |

FOREIGN PATENT DOCUMENTS

| | | |
|---|---|---|
| DE | 258 400 | 3/1912 |
| DE | 258 400 | 4/1913 |
| DE | 689 632 | 3/1940 |
| DE | 725 705 | 8/1942 |
| DE | 258 400 A1 | 7/1988 |
| DE | 39 16 933 A1 | 1/1990 |
| DE | 41 11 262 C1 | 6/1992 |
| DE | 92 14 504.3 | 3/1993 |
| DE | 42 09 006 A1 | 9/1993 |
| DE | 44 43 493 A1 | 6/1996 |
| DE | 195 38 322 A1 | 4/1997 |
| EP | 0 146 687 A1 | 7/1985 |
| EP | 0 146 687 B1 | 7/1985 |
| EP | 0 775 575 A2 | 5/1997 |

OTHER PUBLICATIONS

German Utility Model G 92 14 504.3, dated Mar. 4, 1993, device for adjusting sheet guide elements in rotary printing presses.

* cited by examiner

*Primary Examiner*—Patrick H. Mackey
(74) *Attorney, Agent, or Firm*—Laurence A. Greenberg; Werner H. Stemer; Ralph E. Locher

(57) ABSTRACT

The sheet guide device for machines that process sheets of printing material, such as a sheet-fed rotary printing machine, has a first guide element which has a supporting face inclined transversely with respect to the transport direction of the sheets of printing material. The supporting face supports side edges of the sheets of printing material. The guide element is mounted such that it can be adjusted with an adjusting device in the form of a motor.

14 Claims, 6 Drawing Sheets

Fig.7
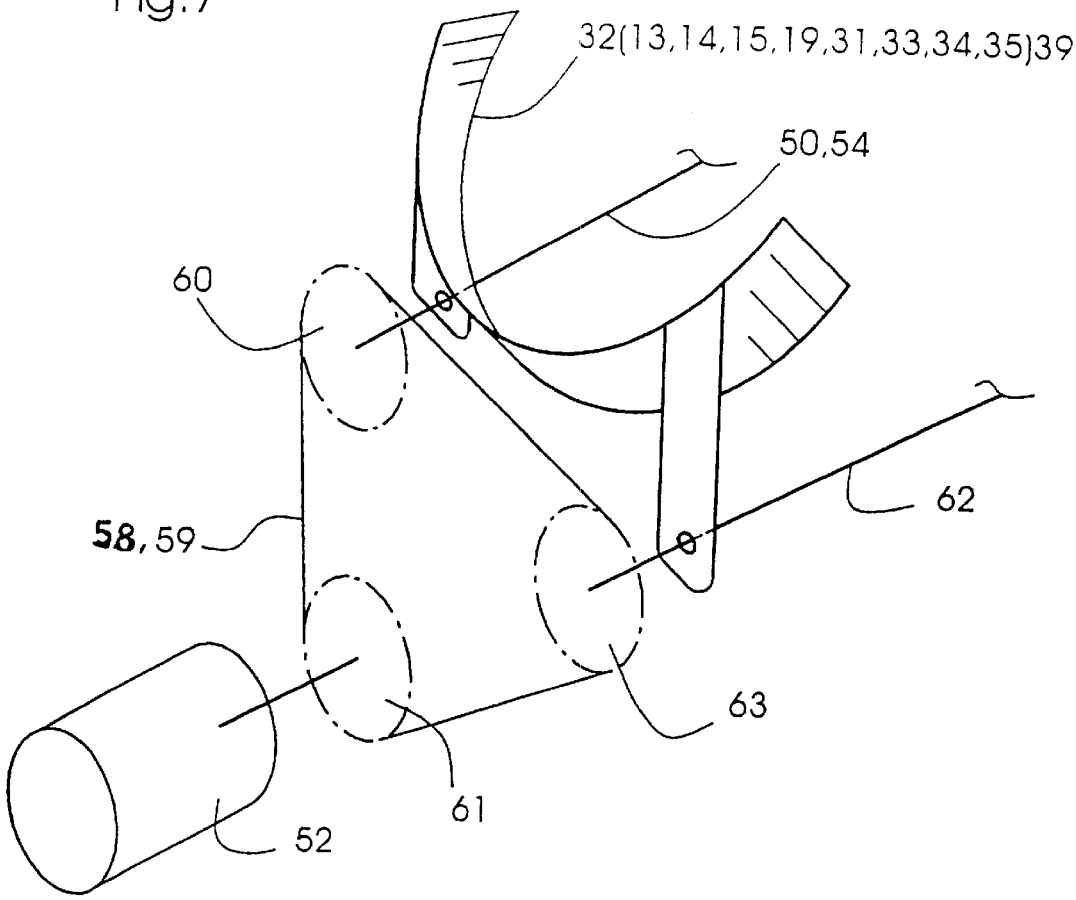
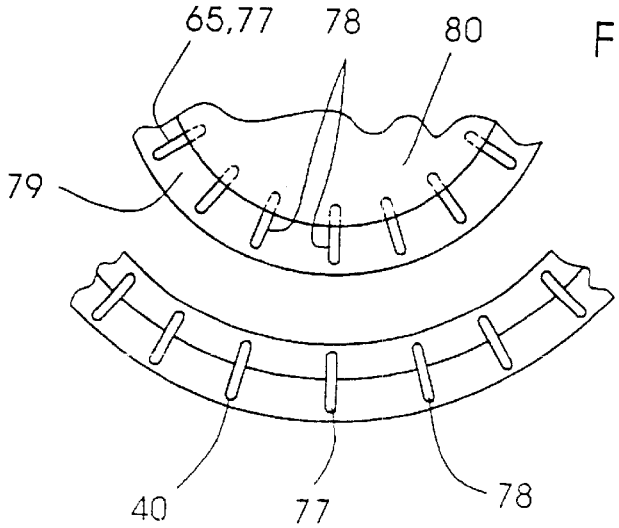
Fig.8

SHEET GUIDE DEVICE FOR SHEET-PROCESSING MACHINE

CROSS-REFERENCE TO RELATED APPLICATION

This application claims the benefit of Provisional Application No. 60/191,154, filed Mar. 22, 2000.

BACKGROUND OF THE INVENTION

FIELD OF THE INVENTION

The invention pertains to a sheet guide device for machines that process sheets of printing material, having a guide element which has a supporting face inclined transversely with respect to the transport direction of the sheets of printing material for side edges of the sheets of printing material, and which is mounted such that it can be adjusted by means of an adjusting device, according to the preamble of claim 1.

Such sheet guide devices, on which the sheets rest with their side edges and thus along a contact line rather than with their faces, are advantageous for the smearfree guidance of stiff sheets.

The guide elements of sheet guide devices of this type can be fixed to cylinders that transport the sheets, corotating with the latter, as is the case in the sheet guide devices described in German published patent application DE 725 705 and in German patent DE 41 11 262 C2, or can be arranged adjacent to the cylinders, as is provided in the sheet guide devices described in German published patent applications DE 258 400 A1 and DE 44 43 493 A1.

The drawback with the sheet guide devices described in the aforementioned printed documents is that changing their format has to be carried out manually by the operator. If, for example, each printing unit of a modern sheet-fed rotary printing machine comprising ten or more printing units is equipped with such a sheet guide device, and each sheet transport device arranged between the printing units is likewise equipped with such a sheet guide device, the result is a large number of operating locations at which the operator has to adjust the guide elements one after another, which results in intolerably high changeover times of the machine.

Furthermore, German published patent application DE 42 09 006 A1 describes a sheet guide device which does not correspond to the above-mentioned generic type, whose guide elements can be adjusted by a motor and are constructed as elements that contact the sheet surface, such as suction rings.

By means of such guide elements, the smearfree transport of the sheets is not ensured under all conditions and, in particular, not when stiff sheets are being printed.

SUMMARY OF THE INVENTION

The object of the invention is to provide a sheet-guide device for machines processing printing material which overcomes the above-noted deficiencies and disadvantages of the prior art devices and methods of this kind, and which, on the one hand, ensures smearfree sheet guidance and, on the other hand, short changeover times.

With the above and other objects in view there is provided, in accordance with the invention, a sheet guide device for a sheet-processing machine in which sheets of printing material are transported along a sheet transport direction. The sheet guide device comprises:

an adjustably mounted guide element formed with a supporting face inclined transversely with respect to the transport direction for supporting side edges of the sheets; and an adjusting device operatively connected with the guide element and comprising a motor for adjusting the guide element.

A sheet guide device constructed in this way is advantageous with regard to automating changing the format of the machine. Changing the format can be carried out after the operator has pressed a knob or after another operating command on an electronic control device linked in control terms to the remotely controllable motor by means of appropriate activation of the motor, which has a drive connection to the guide element in order to displace it, automatically by the control device without the operator having to do anything further. At the same time, print-job-specific data, such as the format width or the side marker position, which have already been input into the control device and stored in the latter, can be processed further in order to activate the motor on the basis of the format.

Provision can be made for the motor to adjust a number of guide elements at the same time, to which the motor has a drive connection via a gear mechanism. Likewise, provision can also be made for a number of motors each having a drive connection to a guide element to have a control link to the control device. Following the operating command, parallel activation of these synchronized motors can be carried out by the control device, for example integrated into a central control desk of the machine, so that the guide elements can be adjusted simultaneously into their positions required for the sheet format width to be set.

In this way, all the guide elements of a machine comprising many printing units can have their format set at once.

In accordance with an added feature of the invention, which is advantageous with regard to the precise fine adjustment of the guide element position in relation to the side edge, a screw mechanism belonging to the adjusting device and via which the motor drives the guide element in order to adjust it is arranged between the motor and the guide element.

In accordance with a further embodiment, which is advantageous with regard to the stable and anti-tilt mounting of the guide element by means of the adjusting device, a threaded spindle belonging to the screw mechanism and a threaded spindle of a further screw mechanism which belongs to the adjusting device and provides a drive connection between the motor and the guide element are mounted axially parallel to each other.

In a further embodiment which is advantageous with regard to an arrangement of the motor axially parallel to the screw mechanism, a flexible drive mechanism, via which the motor drives the screw mechanism in rotation in order to adjust the guide element, is arranged in the drive train between the motor and the screw mechanism.

In a further embodiment which is advantageous with regard to the secure support of the side edges, the supporting face extends convexly and/or concavely in its direction of inclination.

In accordance with an additional feature of the invention, which is advantageous with regard to the lightweight construction of the guide element, the latter consists of a number of supports constructed alongside one another, which together determine the supporting face, which is interrupted at points between the supports.

In a further embodiment which is advantageous with regard to supporting the sheet on both sides by means of motor-adjustable guide elements, the sheet guide device comprises, in addition to the guide element as the first guide element, a second guide element whose supporting face is arranged opposite that of the first guide element and is inclined in mirror-symmetric fashion with respect to the supporting face of the first guide element.

In a further embodiment which is advantageous with regard to the guidance of the sheet in the region of the center of its sheet format width, the first and second guide elements are assigned a third guide element, which is arranged to guide the sheet of printing material in the region between its side edges. If the first guide element and the second guide element, in order to support a sheet, are assigned to a cylinder transporting the sheet and, for example, are fitted to this cylinder, the third guide element, for example in the form of a guide bow, can be fitted to the cylinder and co-rotate with the latter. If the third guide element fitted to the cylinder and co-rotating with the latter is constructed as a blowing device, for example a blowing pipe or a metal sheet provided with blowing openings, a producer of compressed air, for example a blower, can be arranged in the cylinder or external to the cylinder and be connected to the blowing device via a rotary inlet.

In accordance with another feature of the invention, which is advantageous with regard to pneumatically supported sheet guidance, a third guide element can have compressed air applied to it and can be provided with air nozzles directed onto the sheet. Provision can likewise be made for the third guide element to be assigned a blowing device, different from the third guide element, with blowing nozzles directed onto the sheet.

In a further embodiment which is advantageous with regard to the optional adjustment of the sheet guide device either to lightweight and flexible paper sheets to be processed or to heavy and stiff sheets of board to be processed, the distance between the third guide element and a sheet transport device transporting the sheets of printing material past the third guide element can be adjusted by means of a further adjusting device, which comprises a motor for adjusting the third guide element.

In a further embodiment which is advantageous with regard to guiding the sheet as it is being transferred from one cylinder to another cylinder, the first guide element is fixed to the cylinder transferring the sheet, for example a transfer drum or a so-called guide drum, and co-rotates with the latter.

In accordance with again another feature of the invention, which is advantageous with regard to transporting the sheets of printing material by means of a sheet transport device circulating at high speed, for example an impression cylinder, the first guide element is arranged separately from the sheet transport device, immediately adjacent to the latter, and prevents the trailing edge of the sheet, which is held on the sheet transport device at its leading edge, lifting too far off the sheet transport device under the action of centrifugal force.

In accordance with a concomitant feature of the invention, which is advantageous with regard to the remotely controlled setting of the sheet guide device at both side edges of the sheet to the format width of the latter, the first guide element and the second guide element are assigned one and the same motor for driving the guide elements, or the first guide element is assigned a first motor and the second guide element is assigned a second motor. In the event that a motor is assigned to each of the two guide elements, it is possible for an asymmetrical relative position of the sheet of printing material in relation to the center of the machine and transversely with respect to the sheet transport direction to be set particularly simply.

The machine that processes sheets of printing material and which comprises the sheet guide device is preferably a sheet-fed rotary printing machine and may also be a machine that processes the sheets of printing material after they have been printed.

Other features which are considered as characteristic for the invention are set forth in the appended claims.

Although the invention is illustrated and described herein as embodied in a sheet guide device for machines that process sheets of printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 7 is a partial perspective exploded view of a modified construction of the adjusting device;

FIG. 8 is a partial detail of the sheet guide device;

DESCRIPTION OF THE PREFERRED EMBODIMENTS

Figure 1:
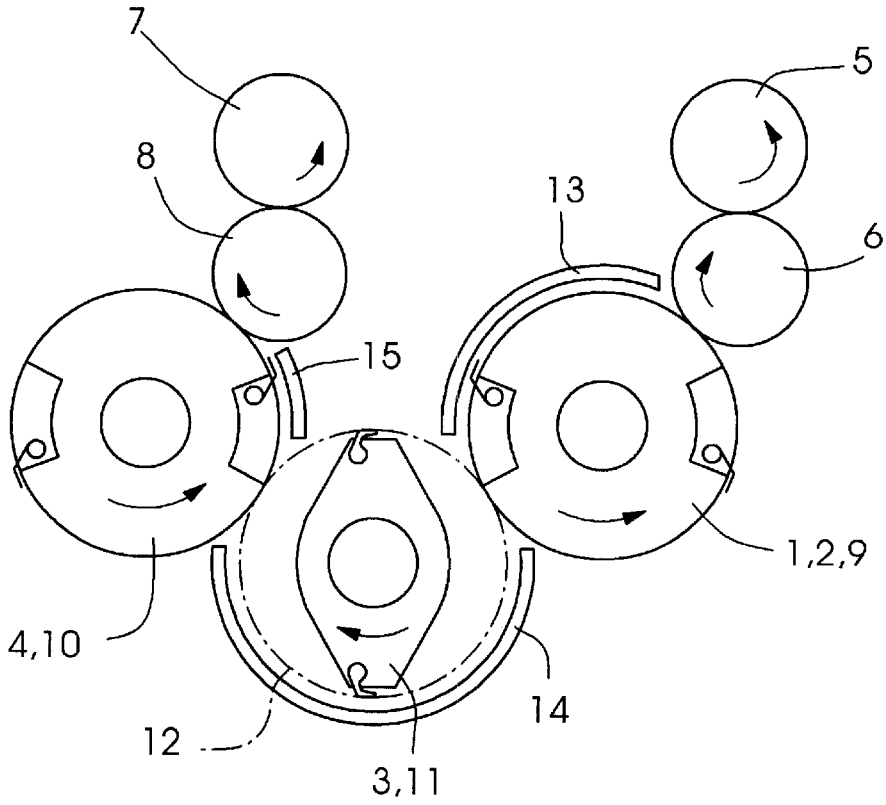
FIG. 1 is a diagrammatic side view of a first printing machine with a number of sheet guide devices.
Figure 2:
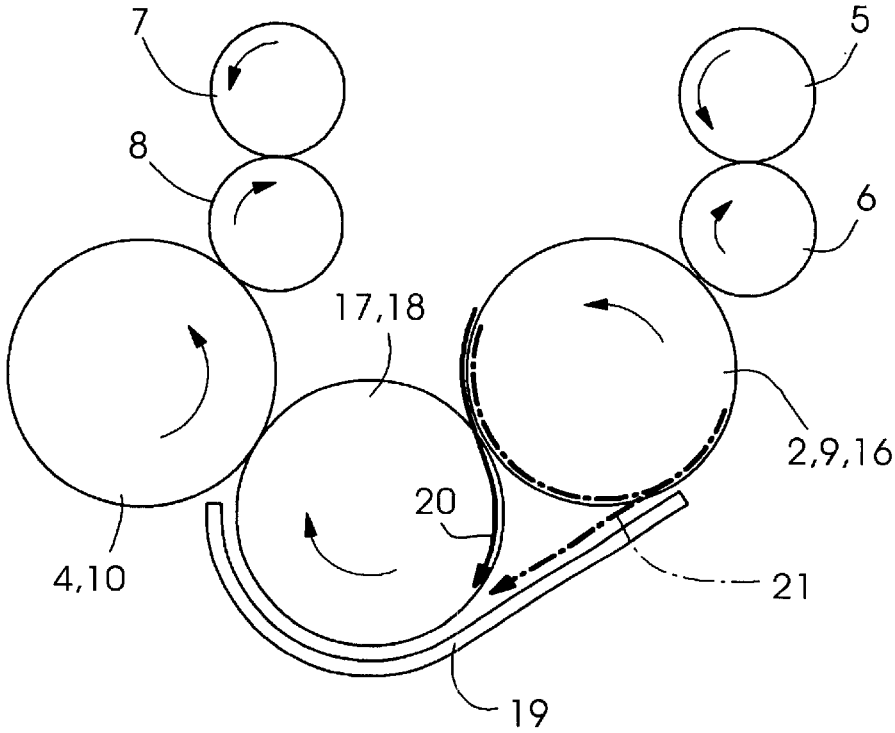
FIG. 2 is a diagrammatic side view of a second printing machine with a number of sheet guide devices.

Referring now to the figures of the drawing in detail and first, particularly, to FIG. 1 thereof, there is seen, schematically and in an extract, a sheet-fed rotary printing machine as a machine 1 that processes sheets of printing material. The machine 1 comprises a number of sheet-carrying cylinders 2 to 4 and a number of ink-carrying cylinders 5 to 8. The cylinders 2 to 4 are multiple-size cylinders, that is to say the peripheral length of each of the cylinders 2 to 4 corresponds to a multiple of the format length of a sheet transported by the cylinders 2 to 4. Put more precisely, the cylinders 2 to 4 are double-size cylinders, of which each is equipped in two diametrically opposite rows with grippers for clamping two sheets at their leading edge. The cylinders 2 and 4 are impression cylinders, on which the sheets rest while the cylinders 6 and 8 apply the ink to the sheets. The cylinders 5 and 7 are printing-plate cylinders, from which the cylinders 6 and 8, as blanket cylinders, transfer the ink to the sheets. The cylinders 2, 5 and 6 are a constituent part of a printing unit 9, and the cylinders 4, 7 and 8 are constituent parts of another printing unit 10 of the machine 1. The cylinder 3 is a sheet transport cylinder which picks up the sheets from the cylinder 2 and transfers them to the cylinder 4, the cylinder 3 being a constituent part of a sheet transport device 11 arranged in between the printing units 9 and 10 in order to transport the sheets from the printing unit 9 to the printing unit 10. The peripheral length of each of the cylinders 2 and 4 and of a flight circle 12 of the grippers of the cylinder 3 in each case correspond approximately to twice the peripheral length of one each of the cylinders 5 to 8. The external contour of the cylinder 3, which is convex and set back in the direction of the center of the cylinder with respect to the flight circle 12, appears to be approximately rhomboidal or elliptical in the side view illustrated. Fitted to the frame of the machine 1, along the sheet transport path and beside the cylinders 2 to 4, are sheet guide devices 13 to 15, whose supporting faces, which are equidistant from the cylinders 2 to 4 and face the cylinders 2 to 4, are curved concavely in the transport direction of the sheets. The sheet guide device 13 extends in the shape of a circular arc, above the cylinder 2, concentrically and at a distance from the latter, in the region of its second quadrant or, put another way, on the sheet outlet side beginning shortly after a press nip formed by the cylinders 2 and 6 as far as shortly before a common tangential sheet transfer point of the cylinders 2 and 3. The sheet guide device 14 extends in the shape of a circular arc, underneath the cylinder 3, concentrically and at a distance from the latter, in the region of the third and fourth quadrants of the latter, over an angle of approximately 180° as referred to the axis of rotation of the cylinder 3 or, put another way, beginning shortly after the sheet transfer point of the cylinders 2 and 3 as far as shortly before a common tangential sheet transfer point of the cylinders 3 and 4. The sheet guide device 15 extends in the shape of a circular arc, above the cylinder 4, concentrically and at a distance from the latter, in the region of its first quadrant or, put another way, beginning shortly after the sheet transfer point of the cylinders 3 and 4, as far as, on the sheet inlet side, shortly before a press nip formed by the cylinders 4 and 8. Illustrated in FIG. 2, schematically and in an extract, is a sheet-fed rotary printing machine as a further machine 16 that processes sheets of printing material. The cylinders 2, 4 to 8 and the printing units 9 and 10 of the machine 16 correspond in functional and constructional terms to those parts of the machine 1 provided with the same reference symbols and therefore do not need to be described again in the following text. The machine 16 is used optionally as a perfecting printing machine and differs from the machine 1 in its sheet transport device 17, designed as a reversing device as opposed to the sheet transport device 11. A cylinder 18, which with its grippers grips the sheet transported by the cylinder 2 in the region of the sheet leading edge during recto printing, the sheet being printed on its front side both in the printing unit 9 and in the printing unit 10, and which grips the sheet in the region of the sheet trailing edge during perfecting, the sheet being printed on its front side in the printing unit 9 and on its rear side in the printing unit 10, and pulls the sheet off the cylinder 2, differs only in its circularly cylindrical peripheral contour from the cylinder 3 of the machine 1. A sheet guide device 19 fitted to the frame of the machine 16 underneath the cylinders 2 and 4 extends with a supporting face which is curved concavely in the transport direction of the sheets—and, more precisely, is curved in a circular arc matched to the cylinder 18—in the region of the third quadrant of the cylinder 18, concentrically and at a distance from the latter, as far as shortly before a common tangential sheet transfer point of the cylinders 4 and 17. The sheet guide device 19 also extends with a supporting face which extends rectilinearly parallel to a tangent which connects the cylinders 2 and 18, in the region of the third quadrant of the cylinder 2 and the fourth quadrant of the cylinder 17. As viewed in the transport direction of the sheets, the rectilinear section of the supporting face adjoins its curved section. The sheet guide device 19 permits both a sheet transport path 20 without the sheet being reversed during recto printing, and a sheet transport path 21 with the sheet being reversed during perfecting.

Figure 3:
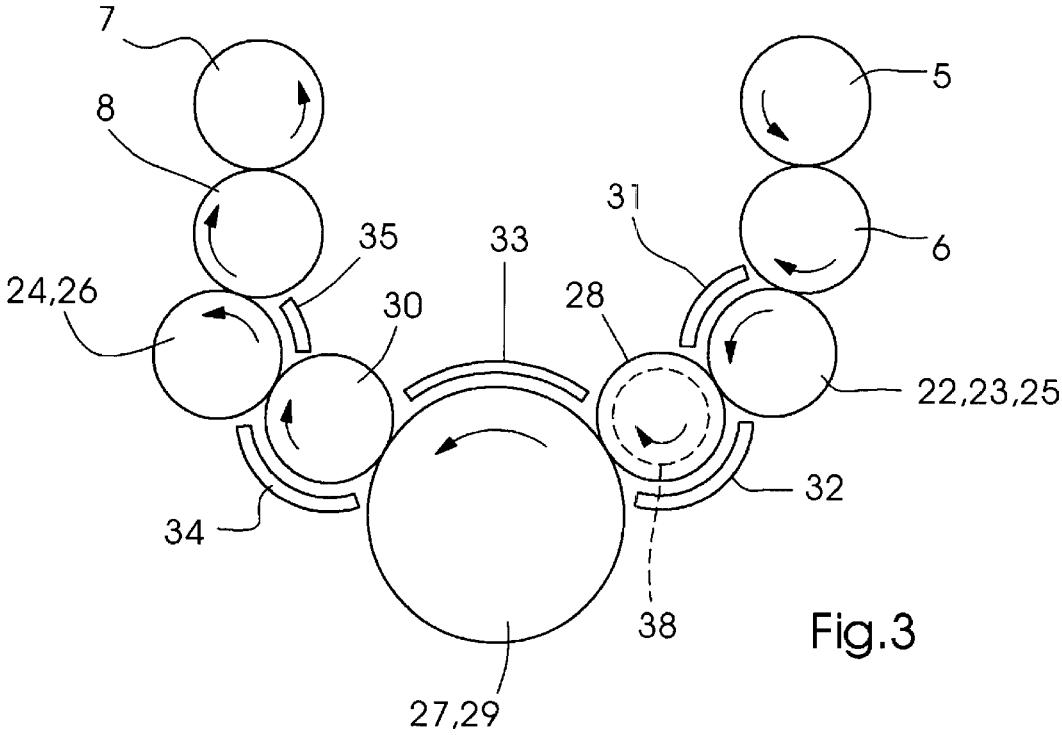
FIG. 3 is a diagrammatic side view of a third printing machine with a number of sheet guide devices.

FIG. 3 illustrates, schematically and in an extract, a sheet-fed rotary printing machine as a further machine 22 that processes sheets of printing material. The cylinders 5 to 8 of the machine 22 correspond in functional and constructional terms with those parts of the machine 1 provided with the same reference symbols and therefore do not need to be described again in the following text. The printing units 23 and 24 of the machine 22 differ from the printing units 9 and 10 of the machine 1 only in their single-size cylinders 25 and 26, which are each equipped with a single row of grippers as impression cylinders and whose diameters correspond to those of the cylinders 5 to 8. A sheet transport device 27, which is arranged between the printing units 23 and 24 in order to transport the sheets from the printing unit 23 to the printing unit 24, comprises a single-size cylinder 28 which is equipped with a single row of grippers and which picks up the sheet from the cylinder 25, a double-size cylinder 29 equipped with two rows of grippers arranged diametrically opposite each other in order to pick up the sheet from the cylinder 28 and to transfer the sheet to a single-size cylinder 30, which is equipped with a single row of grippers and transfers the sheet to the cylinder 26. Fitted to the frame of the machine 22, along the sheet transport path and beside the cylinders 28 to 30, are sheet guide devices 31 to 35, whose supporting faces, which face the cylinders 25, 26, 28 to 30 and are equidistant from the latter, are curved concavely in the transport direction of the sheets. The sheet guide device 31 extends in the shape of a circular arc, above the cylinder 25, concentrically and at a distance from the latter, in the region of its second quadrant or, put another way, beginning shortly after a press nip formed by the cylinders 6 and 25 as far as shortly before a common tangential sheet transfer point of the cylinders 25 and 28. The sheet guide device 32 extends in the shape of a circular arc, underneath the cylinder 28, concentrically and at a distance from the latter, in the region of its third and fourth quadrants or, put another way, on the sheet outlet side beginning shortly after the press nip of the cylinders 6 and 25 as far as shortly before a common tangential sheet transfer point of the cylinders 28 and 29. The sheet guide device 33 extends in the shape of a circular arc, above the cylinder 29, concentrically and at a distance from the latter, in the region of its first and second quadrants or, put another way, beginning shortly after the sheet transfer point of the cylinders 28 and 29 as far as shortly before a common tangential sheet transfer point of the cylinders 29 and 30. The sheet guide device 34 extends in the shape of a circular arc, underneath the cylinder 30, concentrically and at a distance from the latter, in the region of its third and fourth quadrants or, put another way, beginning shortly after the sheet transfer point of the cylinders 29 and 30 as far as shortly before a common tangential sheet transfer point of the cylinders 26 and 30. The sheet guide device 35 extends in the shape of a circular arc, above the cylinder 26, concentrically and at a distance from the latter, in the region of its first quadrant or, put another way, beginning shortly after the sheet transfer point of the cylinders 26 and 30 as far as, on the sheet inlet side, shortly before a press nip formed by the cylinders 8 and 26.

Fitted to the cylinder 28 is a sheet guide device 38 which is coaxial with the latter and which rotates with the cylinder 28. Its supporting face for the sheet extends concentrically with the peripheral line of the cylinder 28 and is set back from the peripheral line of the cylinder 28 in the direction of the axis of rotation of the latter. The sheet guide device 38 is arranged in the interior of the cylinder, between two side plates which close the cylinder 38 at the ends, such that it can be displaced parallel to the axis of rotation of the cylinder 38.

FIG. 4 illustrates once again a detail of the machine 22, which can be operated optionally in recto printing, the sheet being printed on its front side both in the printing unit 23 and in the printing unit 24 or in perfecting, the sheet being printed on its front side in the printing unit 23 and on its rear side in the printing unit 24. In recto printing—cf. FIG. 3—sheet guide device 34 is used, and in perfecting—cf. FIG. 4—a sheet guide device 36 is used instead of the sheet guide device 34. The sheet guide devices 34 and 36 can optionally be displaced toward the cylinder 30 and away from the latter for optional use. In recto printing, the cylinder 30 uses its grippers to grip the sheet transported by the cylinder 29 in the region of its sheet leading edge, and in perfecting, to grip the sheet in the region of its sheet trailing edge, in order to pull the sheet off the cylinder 29. The sheet guide device 36 fitted to the frame of the machine 22 underneath the cylinders 29 and 30 extends with its supporting face section, which is curved concavely in the transport direction of the sheet—and, put more precisely, is curved in the shape of a circular arc matched to the cylinder 29—in the region of the third and fourth quadrants of the cylinder 29, concentrically and at a distance from the latter. In the transport direction of the sheets, the curved section is adjoined by a rectilinear section of the supporting face which, in the region of the third quadrant of the cylinder 29 and in the region of the third and fourth quadrants of the cylinder 30, extends parallel to a tangent connecting the cylinders 29 and 30.

Figure 4:
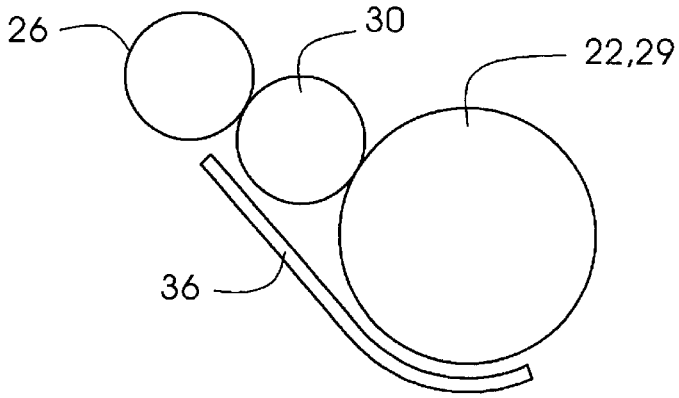
FIG. 4 is a diagrammatic side view of the third printing machine with an exchanged sheet guide device.
Figure 5:
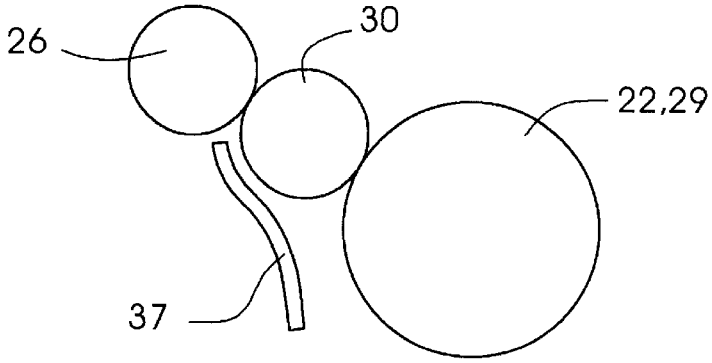
FIG. 5 is a similar view showing a modified configuration of the third printing machine.

FIG. 5 illustrates the machine 22 in a design modified with respect to that in FIGS. 3 and 4. Instead of the two sheet guide devices 34 and 36, in the modified design one and the same sheet guide device 37 is used in recto printing and in perfecting, said device being fitted to the frame of the machine 22 underneath the cylinders 26 and 30. The sheet guide device 37 has a supporting face which is equidistant from the cylinder 30, faces the latter, extends in the region of its third quadrant and has a convexly curved section which, in the transport direction of the sheets, is adjoined by a section which is concavely curved and matched to the cylinder 30, which extends concentrically and at a distance from the cylinder 30 as far as shortly before the common tangential sheet transfer point of the cylinders 26 and 30. The supporting face of the sheet guide device 37 is formed with a slight S-shaped curve, that end of the supporting face that faces away from the sheet transfer point of the cylinders 26 and 30 approximating, in an asymptotic course, to a vertical line extending through the center of the cylinder 30.

The sheet guide devices 13 to 15, 19, 31 to 37 certainly differ from one another with regard to the geometry of their course in the transport direction of the sheets and in their assignment to the various cylinders 2 to 4, 18, 25, 26, 28 to 30, but are identical to one another with regard to their other constructional design. For this reason, this other constructional design of all the sheet guide devices 13 to 15, 19, 31 to 37 will be described below using the example of the sheet guide device 32 seen in side view, that is to say in the sheet transport direction, in FIG. 6, it being possible for the features described to be transferred to the other sheet guide devices 13 to 15, 19, 31, 33 to 35, as is indicated by the reference symbols appended in brackets.

The sheet guide device 32 comprises two guide elements 39 and 40, whose supporting faces 45 and 46, supporting the side edges 41 and 42 of the sheet 44 of printing material transported in the grippers 43 of the cylinder 28, extend in the direction of the ends of the cylinder 28 and toward the latter and are inclined transversely with respect to the transport direction of the sheet 44. The geometrical course of each supporting face 45 and 46 in the transport direction of the sheet 44 has already been explained with reference to FIGS. 1 to 5 and at the same time is referred to as the course of the respective sheet guide device.

Figure 6:
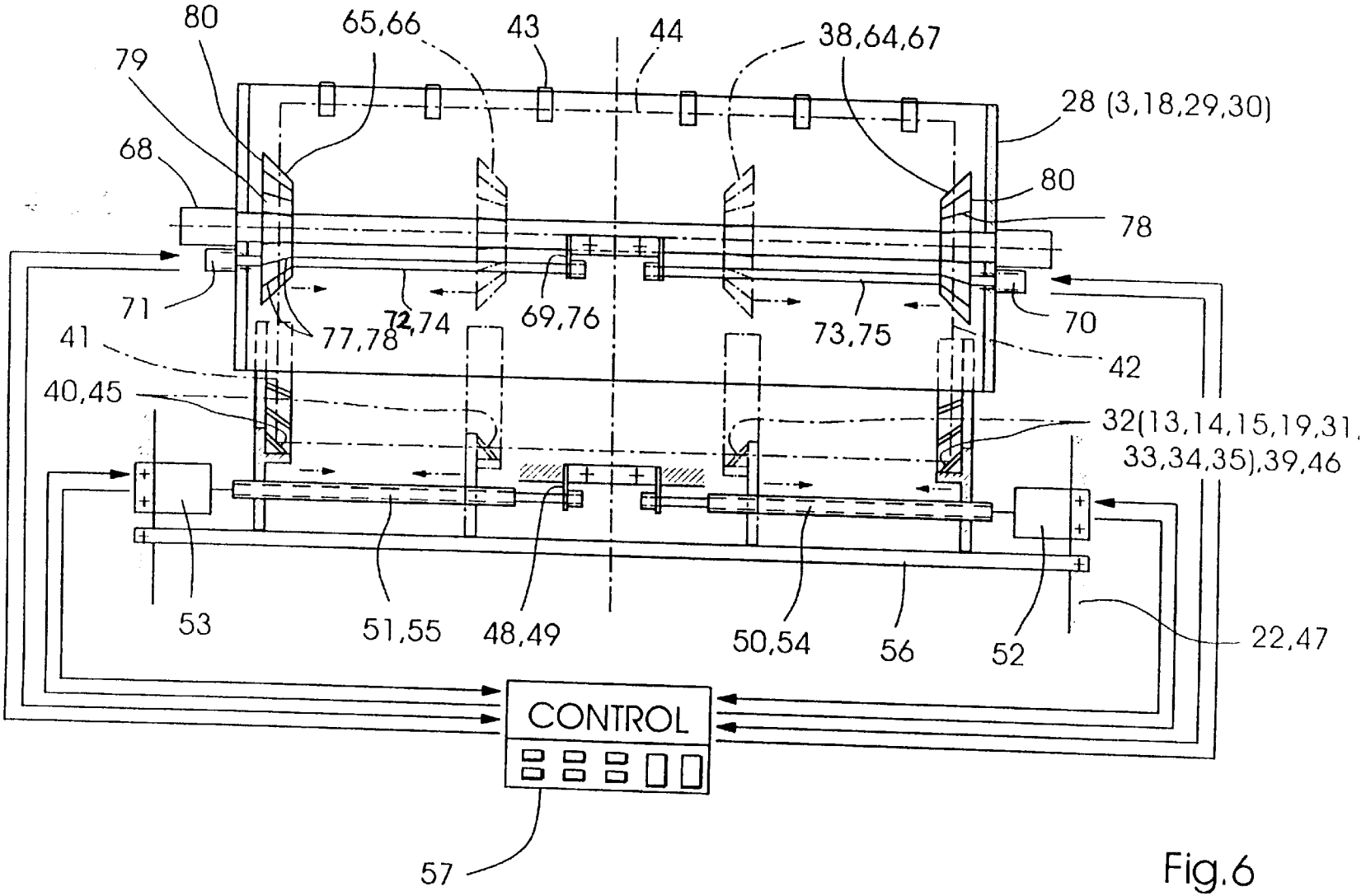
FIG. 6 is a schematic and diagrammatic view of an exemplary embodiment of an adjusting device for the sheet guide devices of all three printing machines.
Figure 9:
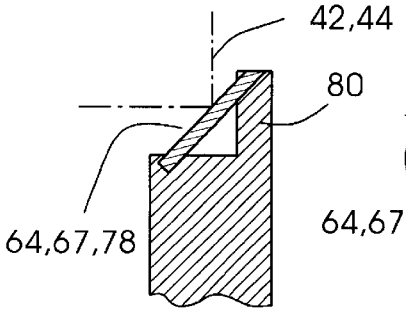
FIGS. 9 to 13 are sectional views showing various possible shapes for supporting faces of the sheet guide device.
Figure 10:
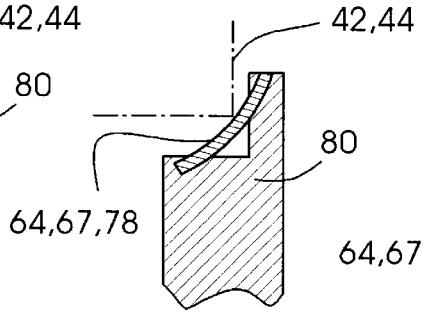
Figure 11:
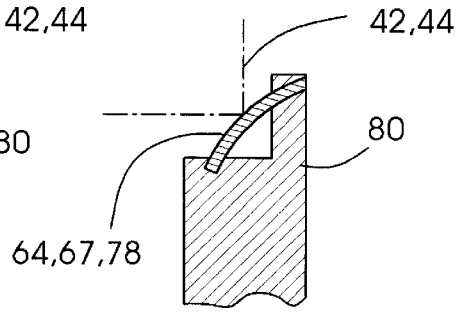

The guide elements 39 and 40 are located opposite each other and, in relation to an ideal and vertical mirror axis located centrally between them, are designed to be symmetrical to each other. An adjusting device 48 fitted to the machine frame 47 is used for the mutually opposed displacement, parallel to the axis of the cylinder 28, of the guide elements 39 and 40 mounted in the adjusting device 48. The adjusting device 48 includes a bearing block 49, in which two threaded spindles 50 and 51 are rotatably mounted at their ends. At their end opposite to the bearing block 48, each of the threaded spindles 50 and 51 is connected coaxially and so as to rotate with a motor shaft of an electric motor 52 and 53 fixed to the machine frame 47, said motor driving the respective threaded spindle 50 and 51 in rotation, by which means the guide element 39 and 40 driven via this threaded spindle 50 and 51 is displaced into a position which corresponds to the format width of the sheet 44 transported past the guide element 39 and 40, with contact with the respective side edge 41 and 42 of the sheet 44. FIG. 6 illustrates the pushed-together position of the guide elements 39 and 40, at minimum format width, with a discontinuous line, and the pushed-apart position, at maximum format width, with a continuous line. Between these two end positions, all intermediate positions for medium formats can be adjusted continuously by means of a corresponding displacement of the guide elements 39 and 40 toward each other and away from each other. Each of the threaded spindles 50 and 51, which are arranged so as to be coaxial with each other, together with the respective guide element 39 and 40 screwed on to them and provided with an internal thread for this purpose, forms a motorized screw mechanism 54 and 55. As a result of the positive connection to a linear guide 56 extending parallel to the adjustment path of the guide element 39 and 40, each of the guide elements 39 and 40 is secured against any rotation in relation to the machine frame 47 in both directions of rotation of the respective threaded spindle 50 and 51. The pitches of the threads of the threaded spindle 50 and 51 and of the guide elements 39 and 40 are comparatively small, so that on the one hand very fine setting of the correct positions of the guide elements 39 and 40 is possible and, on the other hand, self-locking of the screw mechanisms 54 and 55 is provided. Inadvertent rotation of the threaded spindles 50 and 51, and displacement of the guide elements 39 and 40 by forces exerted in the latter in their adjustment direction, for example when the guide elements 39 and 40 are being cleaned of paper dust, is thus not possible.

In order to synchronize the two motors 52 and 53 with each other, provision is made for an electronic control device 57 which is integrated into the central control desk and which activates the motors 52 and 53 in such a way that the latter rotate the threaded spindles 51 and 52 by a number of revolutions which depends on the format width to be set and the lateral position of the sheet in the machine.

In a modification (not specifically illustrated) of the sheet guide device 32 shown in FIG. 6, the two threaded spindles 50 and 51 can be connected to each other so that they rotate together at their ends mounted in the bearing block 49, so that they form a single threaded spindle which, if the motor 53 fails, is driven solely by the motor 52. Since the guide element 39 is screwed onto a portion of this single threaded spindle which is provided with a left-hand thread, and the guide element 40 is screwed onto a portion of the same threaded spindle which is provided with a right-hand thread, the guide elements 39 and 40 are moved in the same direction toward each other or away from each other, depending on the direction of rotation of the threaded spindle and of the motor 52. In this case, an asymmetrical position of the sheet relative to the center of the machine can be set by displacing the threaded spindle, together with the guide plates, transversely with respect to the sheet transport direction, for which purpose the threaded spindle can be assigned a drive and a gear mechanism for its displacement.

A further modification of the sheet guide device 32 shown in FIG. 6 is illustrated in FIG. 7. In this modification, the motor 52 drives the screw mechanism 54 via a flexible drive mechanism 58, whose intrinsically self-contained flexible drive 59 runs around a wheel 60 which is coaxial with the threaded spindle 50 and connected so as to rotate with it, a wheel 61 which is coaxial with the motor shaft of the motor 51 and connected so as to rotate with it, and a wheel 63 which is coaxial with a threaded spindle 62 axially parallel to the threaded spindle 50 and is connected to rotate with it, and meshes with positive engagement with the wheels 60, 61 and 63. For example, the wheels 60, 61 and 63 are toothed pulleys, if the flexible drive 59 is a toothed belt, and sprockets, if the flexible drive 59 is an articulated chain. The wheels 60 and 63 are identical to each other with regard to their number of teeth and their pitch circle diameter. The threaded spindle 62 is screwed into the guide element 39 so as to be offset with respect to the threaded spindle 50, and the two threaded spindles 50 and 62 are each provided with a thread, these two threads having the same pitch and either both being right-hand threads or both being left-hand threads. Thus, the two threaded spindles 50 and 62 are driven in the same direction of rotation by the flexible drive mechanism 58 in synchronism with the motor 52, as a result of which the guide element 39 is displaced with a parallel action.

The sheet guide device 38 differs essentially from the sheet guide device 32 on the one hand in that the sheet guide device 38 is fitted not to the frame but to the cylinder 28, and in that the guide elements 64 and 65 arranged opposite the guide elements 39 and 40 are constructed with supporting faces 66 and 67 which are curved convexly in the transport direction of the sheet 44. Because they are fixed to the cylinder 28, the guide elements 64 and 65 rotate together with the latter. On the other hand, the supporting faces of the sheet guide device 38 are external tapers or cones and not internal tapers or cones, like those of the sheet guide device 32. The guide elements 64 and 65 are constructed like segments of an annulus or ring and are arranged coaxially with the cylinder 28 such that they can be displaced along a shaft serving as a linear guide 68 and belonging to the cylinder 28. An adjusting device 69 for the axial displacement of the guide elements 64 and 65 comprises screw mechanisms 72 and 73 driven by the motors 70 and 71 and having threaded spindles 74 and 75 and a bearing block 76. Since parts 69 to 76 correspond in functional and constructional terms to the parts 48 to 56, the parts 68 to 76 do not need to be discussed in more detail again at this point.

At this point, it should once again be emphasized that the cylinder 3—cf. FIG. 1—and the cylinder 18—cf. FIG. 2—can also be equipped with the sheet guide device 38, the parts 64 to 80 being integrated in the cylinder 3 or 18.

Of course, the modifications described in connection with the adjusting device 48, that is to say using a single threaded spindle with two opposite-direction threads instead of the two threaded spindles arranged so as to align with each other for driving both guide elements by means of a single motor, displacing a guide element by means of two threaded spindles assigned to the guide element and aligned parallel to each other, and driving the screw mechanism and the guide element via a flexible drive mechanism, can be transferred to the setting device 69.

As can be seen particularly well in FIG. 6 with reference to the guide elements 64 and 65, each guide element designed in the manner of a grid and previously mentioned in the description of the invention comprises a large number of supports 77 and 78, which are held together by a carrier 80, in each case with a clearance 79 between two supports 77 and 78, and are arranged to extend away from one another in the shape of a bundle of rays. The supports 77 and 78 can be formed as rib-like webs or as a tensioned wire. The supports 77 and 78 can also be formed as rollers, but the rotationally fixed arrangement of the supports 77 and 78, omitting rotary bearings, is particularly beneficial in terms of production economics. As a result of the motorized adjustment of the carrier 80 of the respective guide element, all its supports 77 and 78 are displaced at the same time.

FIG. 8 illustrates the multi-part construction of the guide elements 40 and 65 again in side view, as representative of the other guide elements.

As distinct from the design shown, each of the aforementioned guide elements can be provided with a single uninterrupted supporting face, instead of comprising a large number of supports, and can be formed, for example, as a guide plate. Such a solid-area guide plate can be produced particularly simply in the form of a segment of the outer surface of a cone by means of metal-sheet forming without removal of material.

Figure 12:
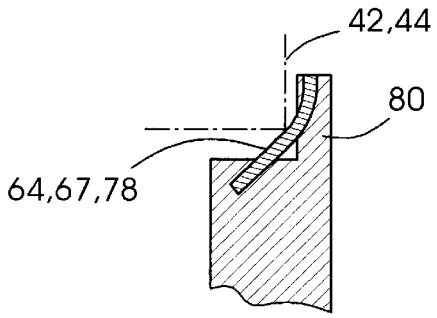
Figure 13:
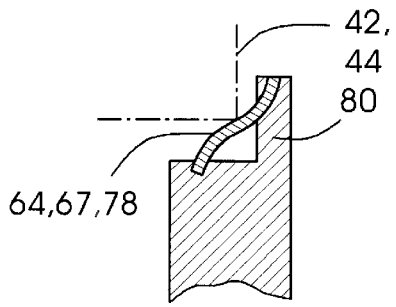

FIGS. 9 to 13 show various geometrical variants of the course 4 of the supporting face 67 transversely with respect to the sheet transport direction, using the example of the guide element 64, which is illustrated from a direction of view corresponding to FIG. 6 but on an enlarged scale and in section, it being possible for these variants to be transferred readily to all the other guide elements. According to FIG. 9, the supporting face 67 extends only linearly, according to FIG. 10 it is curved only concavely and according to FIG. 11 it is curved only convexly. FIG. 12 shows a variant in which the supporting face 67 has a linear section and a concavely curved section adjoining the latter. According to the variant illustrated in FIG. 13, the supporting face 67 has a concave section and a convex section which merge into each other. The average inclination of the supporting face 67 transversely with respect to the sheet transport direction is approximately 45° in all variants.

Figure 14:
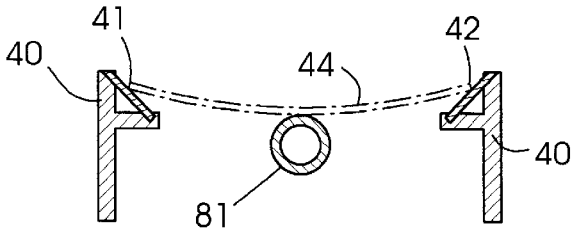
FIG. 14 is a sectional view of an additional guide element, supporting the sheet centrally, of the sheet guide device.
Figure 15:
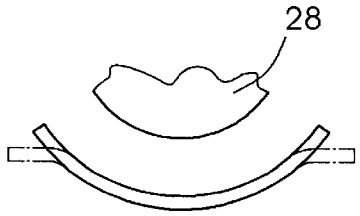
FIG. 15 is a side view of the additional guide element.

FIG. 14 shows, using the example of the sheet guide device 32 as representative of the sheet guide devices 13 to 15, 19, 31 to 35, that in the region of the center of the format width of the sheet 44, on the side of the sheet opposite the cylinder 28—cf. FIG. 6—said sheet is assigned a further guide element 81, in addition to the guide elements 39 and 40, which is particularly advantageous in the case of sheets 44 which sag considerably transversely to the sheet transport direction because of their weight. The guide element 81, which is constructed as a rod-like hollow profile, for example as a tube, has a longitudinal extent in the direction of the transport path of the sheet 44. Over the major part of its length, the guide element 81 extends at a distance from the cylinder 28, concentric with the outer periphery of the latter, as can be seen in FIG. 15. The ends of the guide element 81 deviate from its concentric course and are curved away from the cylinder 28. Heavy and stiff sheets 44 are supported on the guide element 81 as they are being transported. The round-profiled guide element 81 is arranged in such a way that the stiff sheet 44 slides only with its trailing edge on the guide element 81 and not at all with its face, that is to say virtually with point contact. In some cases it may be necessary, instead of a single guide element 81, to arrange a number of guide elements, for example three guide elements, which are of comparable design to the guide element 81 between the guide elements 39 and 40.

Figure 16:
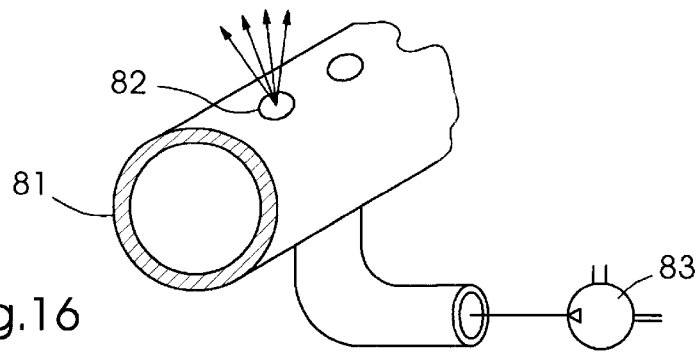
FIG. 16 is a partial perspective view of the additional guide element with pressurized-air openings in detail.

FIG. 16 illustrates that the guide element 81 is provided with blown-air openings 82 and is connected to a generator 83 of overpressure, for example a blower or a compressor, which provides blown air that flows out of the nozzles 82. If, instead of the sheets 44 consisting of board, sheets of paper with a reduced stiffness are to be processed in the machine, the contactless pneumatic support of these sheets of paper by the guide element 81 to which compressed air is applied is particularly advantageous. The machine containing the guide element 81 is thus best equipped for the optional processing of sheets of board or sheets of paper.

Figure 17:
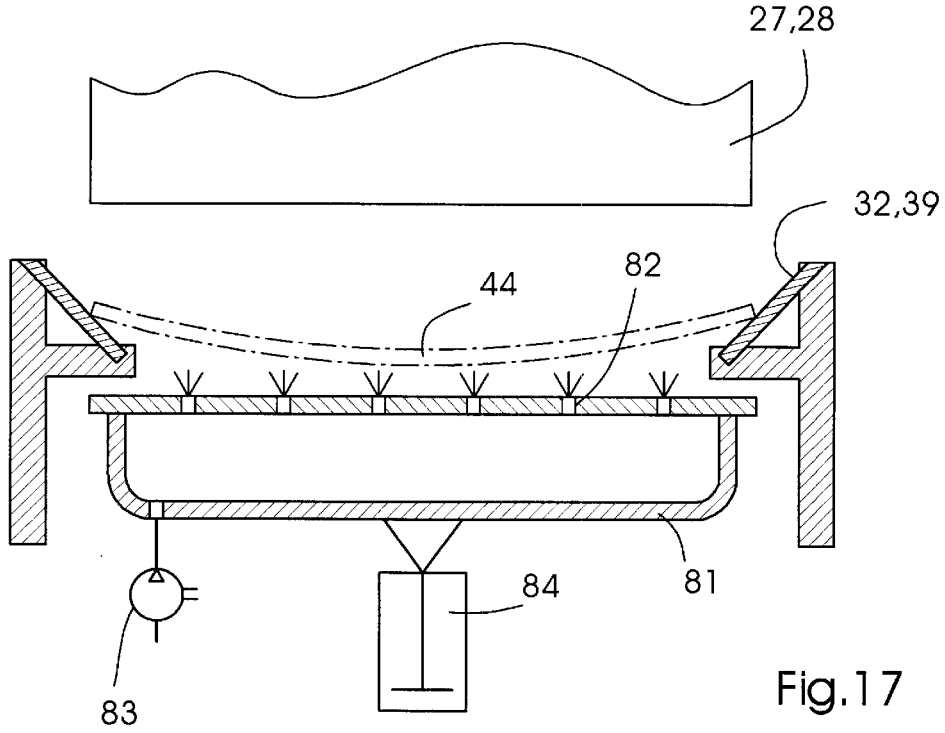
FIG. 17 is a sectional and schematic view of a modification of the additional guide element in a position withdrawn from a cylinder.

In a modification of the guide element 81, shown in FIG. 17, said element is not designed as a thin blowing pipe but as a blowing box which essentially reaches over the entire format width of the sheet 44 and whose plate, provided with nozzles 82, can be curved in the sheet transport direction in exactly the same way as the blowing pipe—cf. FIG. 15. By means of an actuating drive 84, for example a reciprocating piston cylinder to which compressed fluid can be applied, the guide element 81 is adjustable in the direction of the sheet transport device, that is to say toward the cylinder 28 and away from the latter. In order to process stiff sheets 44, the guide element 81 can thus be withdrawn from the cylinder 28, and the guide elements 39 and 40 guiding the stiff sheets can be moved into a position corresponding to the format width of the sheet in the interspace between the cylinder 28 and the guide element 81, as shown in FIG. 17.

Figure 18:
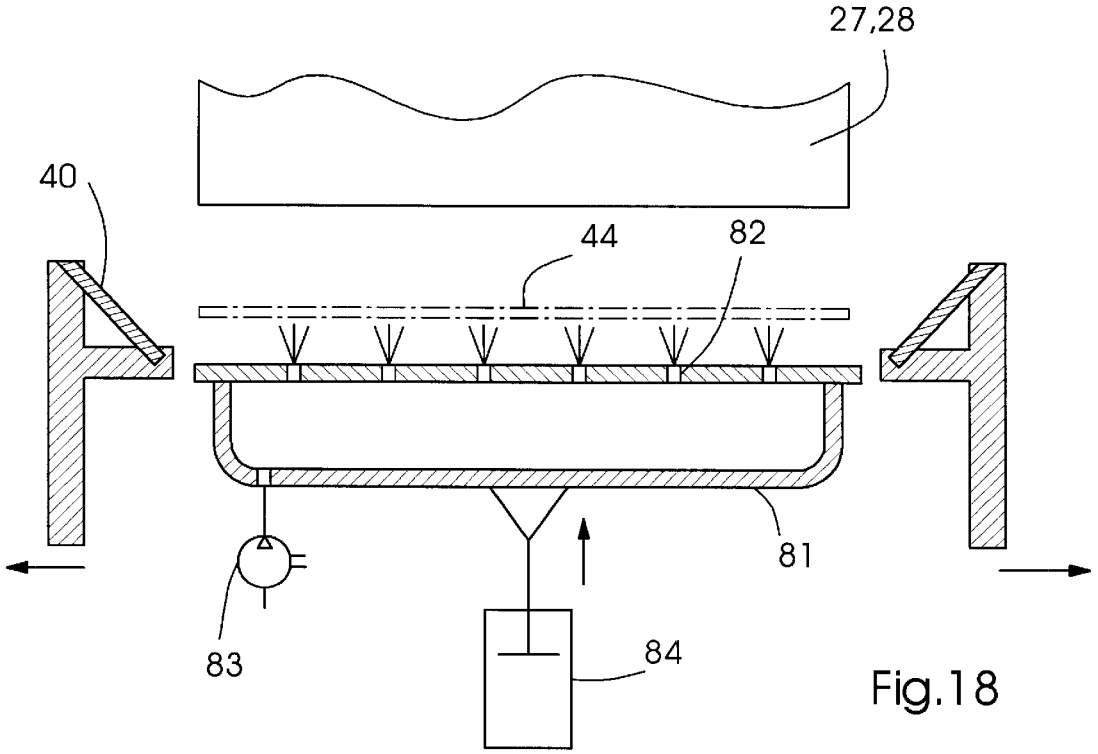
FIG. 18 is a similar view of the modified additional guide element in a position advanced toward the cylinder.

In order to process lightweight and flexible sheets 44, the guide elements 39 and 40 can be moved apart by means of the adjusting device 48 beyond the positions corresponding to the maximum format width which can be processed, so that the guide element 81 can be set closer to the cylinder 28 between the guide elements 39 and 40, as shown in FIG. 18. The guide element 81, which can be displaced at right angles to the direction of displacement of the guide elements 39 and 40 has positive pressure applied to it in its position moved toward the cylinder 28, so that the blown air flowing out of the nozzles 82 forms a supporting air cushion between the sheet 44 and the sheet guide element 81, as a result of which the sheet 44 slides during its transport without any contact with the sheet guide element 81.

Although in each case only two printing units and a sheet transport device arranged between these in the respective printing machine are illustrated in FIGS. 1 and 3, the latter further comprises a large number of further such printing units and sheet transport devices, which are all equipped with the above-described sheet guide devices which can be adjusted by motor at the same time, so that the changeover time of the printing machine is very short.

I claim:

1. A sheet guide device for a sheet-processing machine in which sheets of printing material are transported along a sheet transport direction, the sheet guide device comprising:

an adjustably mounted first guide element formed with a supporting face inclined transversely with respect to the sheet transport direction for supporting first side edges of the sheets;

a second guide element with a supporting face inclined transversely with respect to the sheet transport direction for supporting second side edges of the sheets opposite the first side edges;

a third guide element disposed between said first guide element and said second guide element; and an adjusting device operatively connected with said first guide element and including a motor for adjusting said first guide element.

2. The sheet guide device according to claim 1, which comprises a screw mechanism establishing a drive connection between said motor and said first guide element.

3. The sheet guide device according to claim 2, wherein said screw mechanism comprises a threaded spindle arranged axially parallel to a further threaded spindle.

4. The sheet guide device according to claim 1, which comprises a flexible drive mechanism forming a drive connection from said motor to said first guide element.

5. The sheet guide device according to claim 1, wherein said supporting face is curved transversely with respect to the sheet transport direction.

6. The sheet guide device according to claim 1, wherein said first guide element includes a plurality of mutually spaced-apart supports together covering said supporting face.

7. The sheet guide device according to claim 1, wherein said third guide element is formed with pressurized-air openings.

8. The sheet guide device according to claim 1, wherein said third guide element is adjustably mounted toward a sheet transport device transporting the sheets of printing material, and away from the transport device, and including a motorized adjusting device for adjusting said third guide element.

9. The sheet guide device according to claim 1, wherein said first guide element is adjustably mounted on a sheet transport device of the sheet-processing machine circulating about and transporting the sheets of printing material.

10. The sheet guide device according to claim 1, wherein said first guide element is adjustably mounted adjacent a sheet transport device on a frame of the sheet-processing machine circulating about and transporting the sheets.

11. The sheet guide device according to claim 1, wherein said second guide element is adjustably mounted for adjustment by said motor.

12. The sheet guide device according to claim 1, which comprises a further motor, and wherein said second guide element is adjustably mounted for adjustment by said further motor.

13. In combination with a machine processing sheets of printing material in which the sheets are transported along a sheet transport direction, a sheet guide device comprising:

an adjustably mounted first guide element formed with a supporting face inclined transversely with respect to the sheet transport direction for supporting first side edges of the sheets;

a second guide element with a supporting face inclined transversely with respect to the sheet transport direction for supporting second side edges of the sheets opposite the first side edges;

a third guide element disposed between said first guide element and said second guide element; and an adjusting device operatively connected with said first guide element and including a motor for adjusting said first guide element.

14. In combination with a sheet-fed rotary printing machine in which sheets of printing material are transported along a sheet transport direction, a sheet guide device comprising:

an adjustably mounted first guide element formed with a supporting face inclined transversely with respect to the sheet transport direction for supporting first side edges of the sheets;

a second guide element with a supporting face inclined transversely with respect to the sheet transport direction for supporting second side edges of the sheets opposite the first side edges;

a third guide element disposed between said first guide element and said second guide element; and an adjusting device operatively connected with said first guide element and including a motor for adjusting said first guide element.

* * * * *